US012679604B2

(12) United States Patent
Engelhard

(10) Patent No.: US 12,679,604 B2
(45) Date of Patent: Jul. 14, 2026

(54) TRANSPORT CONTAINER AND METHOD FOR AUTOMATED MICROBIAL MONITORING IN A BARRIER SYSTEM

(71) Applicant: Groninger & Co. GmbH, Crailsheim (DE)

(72) Inventor: Roland Engelhard, Aurach-Weinberg (DE)

(73) Assignee: GRONINGER & CO. GMBH, Crailsheim (DE)

( * ) Notice: Subject to any disclaimer, the term of this patent is extended or adjusted under 35 U.S.C. 154(b) by 0 days.

(21) Appl. No.: 18/773,822

(22) Filed: Jul. 16, 2024

(65) Prior Publication Data

US 2024/0367866 A1 Nov. 7, 2024

Related U.S. Application Data

(63) Continuation of application No. PCT/EP2023/050881, filed on Jan. 16, 2023.

(30) Foreign Application Priority Data

Jan. 17, 2022 (DE) ..... 10 2022 101 001.5
Jul. 13, 2022 (DE) ..... 10 2022 117 490.5

(51) Int. Cl.
*B65D 41/06* (2006.01)
*B65B 55/02* (2006.01)

(52) U.S. Cl.
CPC ..... *B65D 41/065* (2013.01); *B65B 55/027* (2013.01); *B65D 2313/04* (2013.01)

(58) Field of Classification Search
None
See application file for complete search history.

(56) References Cited

U.S. PATENT DOCUMENTS 11,066,631 B2 7/2021 Decker et al.
11,951,468 B2 4/2024 Schafrinski
2007/0267379 A1* 11/2007 Creasap ..... B65D 41/065 215/201

(Continued)

FOREIGN PATENT DOCUMENTS

CN 214397787 U * 10/2021
DE 202016004498 U1 10/2017

(Continued)

OTHER PUBLICATIONS

International Preliminary Report on Patentability issued for PCT/EP2023/050881 on Jul. 23, 2024.

(Continued)

*Primary Examiner* — Tanzim Imam
(74) *Attorney, Agent, or Firm* — Reising Ethington P.C.

(57) ABSTRACT

A transport container for at least one nutrient medium carrier, wherein the transport container comprises a base element and a cover element, the base element and the cover element are connectable to each other, the base element and the cover element are connected to each other in a closed state of the transport container and enclose an interior space of the transport container, and the at least one nutrient medium carrier can be arranged in the interior space. Furthermore, a method for automated microbial monitoring in a barrier system is provided.

5 Claims, 4 Drawing Sheets

(56) References Cited

U.S. PATENT DOCUMENTS

Figure 1:
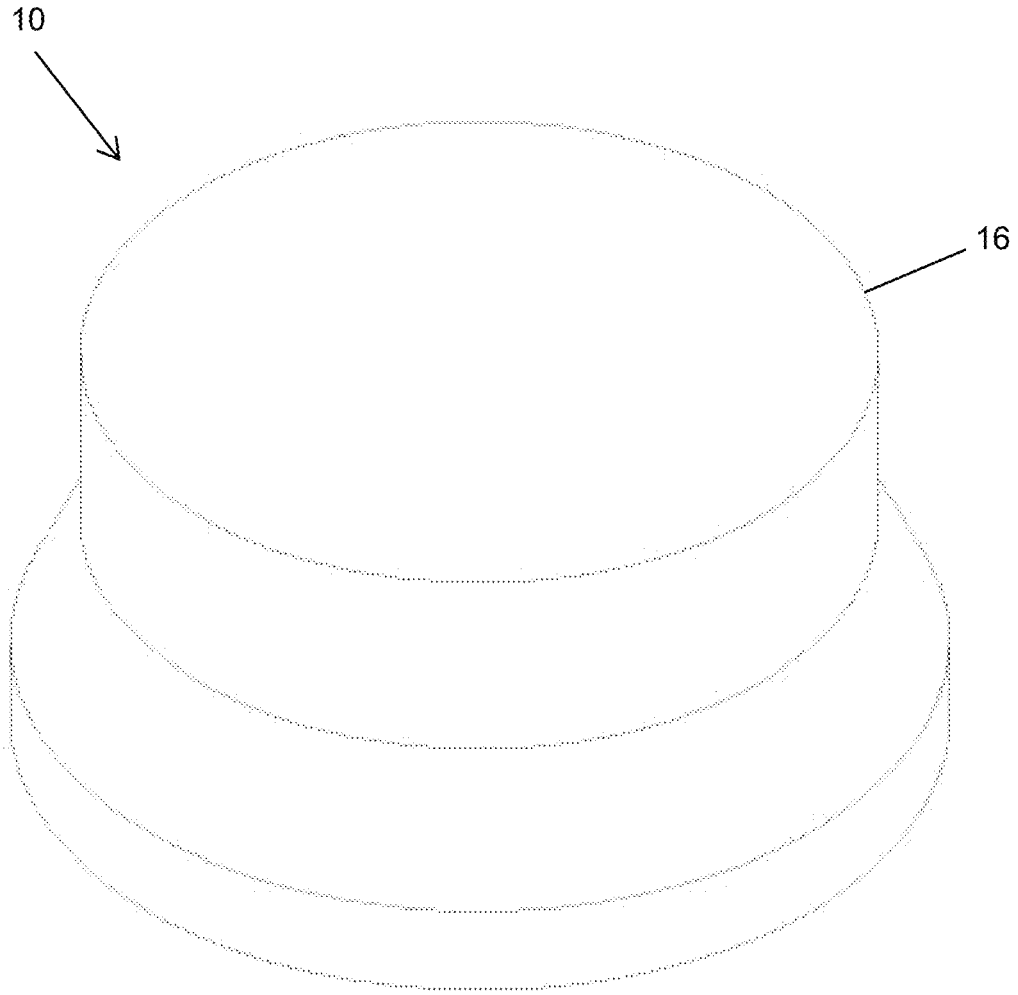

| | | | | |
|---|---|---|---|---|
| 2011/0067781 | A1* | 3/2011 | Osborne | B65B 55/00 141/37 |
| 2021/0292051 | A1* | 9/2021 | Andrews | A45C 13/1069 |
| 2022/0297897 | A1* | 9/2022 | Kealy | B65D 51/242 |
| 2022/0380710 | A1 | 12/2022 | Merz et al. | |
| 2023/0020880 | A1 | 1/2023 | Merz et al. | |

FOREIGN PATENT DOCUMENTS

| | | | | |
|---|---|---|---|---|
| DE | 102020102758 | A1 | 8/2021 | |
| DE | 102020102768 | A1 | 8/2021 | |
| DE | 202021104825 | U1 | 9/2021 | |
| EP | 2518136 | A1 | 10/2012 | |
| EP | 2321402 | B1 | 7/2017 | |
| EP | 3539420 | A1 | 9/2019 | |
| EP | 3896144 | A1 | 10/2021 | |
| JP | 2013039103 | A | 2/2013 | |
| WO | WO2007080600 | A1 | 7/2007 | |
| WO | WO2009147252 | A1 | 12/2009 | |
| WO | WO-2013176106 | A1 * | 11/2013 | B01L 3/50825 |

OTHER PUBLICATIONS

Aseptic Transfer Systems Into and Out of Barrier Isolators and RABS; Containment Technology, Springer-Verlag, Berlin, Heidelberg, pp. 81-104; Jan. 31, 2013 URL: www.springer.com/gp/book/97836/42392917.

International Search Report and Written Opinion issued for PCT/EP2023/050881 on May 4, 2023.

* cited by examiner

TRANSPORT CONTAINER AND METHOD FOR AUTOMATED MICROBIAL MONITORING IN A BARRIER SYSTEM

CROSS-REFERENCE TO RELATED APPLICATIONS

This is a continuation application of International patent application PCT/EP2023/050881, filed Jan. 16, 2023, which claims the priority of German patent application DE 10 2022 117 490.5, filed Jul. 13, 2022, and DE 10 2022 101 001.5, filed Jan. 17, 2022. PCT/EP2023/050881, DE 10 2022 117 490.5 and DE 10 2022 101 001.5 are all incorporated herein by reference in their entireties.

FIELD

The present invention generally relates to a transport container for at least one nutrient medium carrier and a method for automated microbial monitoring in a barrier system.

BACKGROUND

A barrier system is understood to be a system that provides a physical and aerodynamic barrier, for example by means of positive air pressure, between an external environment, such as an external cleanroom environment, and a working process. Various barrier systems are known in the prior art. A barrier system can, for example, be an isolator or a Restricted Area Barrier System (RABS). The RABS can be an open RABS or a closed RABS.

The present application primarily deals with aseptic isolators as barrier systems, which, for example, have a filling area for filling objects (e.g., vials, cartridges, bottles, syringes, and/or the like) with fluid by means of filling needles. However, the present application can also be applied in other barrier systems.

The term "isolator" is generally understood to mean a container that is hermetically and gas-tight sealed from the surrounding workspace. Within an isolator, a defined atmosphere can be created for processing sensitive or hazardous products.

In this context, isolators are usually used in biopharmaceutical process technology, for example, as part of a filling system with multiple process and processing stations, to create a highly pure or sterile, i.e., germ-free environment and to avoid contamination by microbes, particularly bacteria, viruses, pathogens, and/or the like.

Pharmaceutical filling systems are generally located in a low-germ environment. A germ-free environment must be present in the filling area within the isolator. This condition is monitored by placing microbe collectors at critical points. Microbe collectors can also be referred to as nutrient medium carriers. Nutrient medium carriers can, for example, be Petri dishes that contain a nutrient medium. When a microbe comes into contact with the nutrient medium, the microbe grows during subsequent incubation, allowing contamination to be retrospectively detected. Such monitoring of a germ-free environment is referred to as "microbial monitoring" or "microbiological monitoring".

For microbial monitoring of an isolator, nutrient medium carriers can be used, which are positioned inside the isolator and exposed to the airflow of the laminar flow. In particular, the nutrient medium carriers can also be positioned in a receptacle of a monitoring device that is placed inside the isolator and actively draws in or pulls through air. Microbes present in the incoming air can settle on the nutrient medium of the nutrient medium carrier.

These nutrient medium carriers are introduced into the system, specifically into the isolator, via a port system. Receptacles must be provided in the beta containers, into which the closed nutrient medium carriers are placed in advance. The container is then appropriately sealed. The nutrient medium carriers can also be packaged in foil. This must all be done via a preparation isolator to ensure that the components involved are handled sterilely and remain sterile.

The method known for introducing the nutrient medium carriers into an isolator has the following disadvantages. First, a port system must be provided on the isolator. Alpha ports and beta containers are expensive. Furthermore, if multiple sets of nutrient medium carriers are required, multiple containers are also needed; alternatively, a single container must be refitted sequentially, which is time-consuming. Additionally, the port is always located in the wall of the isolator. This means that the placement is always dependent on a free area in the isolator wall and the accessibility of the handling manipulator. Finally, due to the special port system, there is also a dependency on a cooperating container manufacturer.

The document WO 2013/176106 A1 describes a transport container that securely transports a cell sheet over long distances, such as from one hospital to another, and can be combined with a universal Petri dish that can be procured in any medical environment. This container is provided with: a main container body with an opening part and a bottom part on which a lower tray of a Petri dish can be placed; a cover body that is arranged on the opening part and covers the opening part and the lower tray; and a connecting means that can detachably connect the cover body with the main container body. On the inner side of the cover body, a sealing material is provided that contacts the entire circumference of the upper edge of the lower tray, and an inlet for injecting or discharging a culture solution and a closing tool for closing the inlet at the base part of the cover body. When the cover body is connected to the main container body while the lower tray is placed on it, an interior space is created, which can be filled with the culture solution via the inner surfaces of the lower tray and the inner surface of the cover body, forming a cell layer.

The document JP 2013 039103 A describes a packaging container for carrying a biological sample or the like, which is capable of transporting the sample in a state where purity is maintained and allows non-invasive examination while maintaining purity after transport. The packaging container comprises a body part of a first packaging container that holds a sample container including the sample inside on the bottom surface and is translucent, a cover part of the first packaging container that seals the body part of the first packaging container and is translucent, a body part of a second packaging container that holds the body part of the first packaging container, which is sealed with the cover part of the first packaging container on the bottom surface, and is translucent, and a cover part of the second packaging container that seals the body part of the second packaging container and is translucent.

The document WO 2007/080600 A1 describes a disposable device for cultivating and/or packaging and transporting ready-to-use viable cells, which are cultivated on membranes, gels, or microporous substrates. The device comprises a housing base that defines an interior space for cultivating cells. The membrane to be used for cell cultivation is placed in the housing base and fixed with a ring. The base is closed by a cover that protects the cells underneath during transport and minimizes the volume of the medium used during cultivation and transport. Media leakage is prevented by the silicone seal and the snap closures provided in the device.

The document DE 20 2021 104 825 U1 describes a sterile container for sterilizing medical items, comprising: a container base, a container cover, and a locking device that is suitable for fixing the cover to the base such that the two form a sterilizable container interior; a shape memory element, by means of which a display unit of the sterile container can be moved into a sterile position and/or a locking element of the sterile container can be moved into a locking position, in which the locking element prevents the locking device from being released; wherein the sterile container comprises a blocking device that is arranged such that it prevents the display unit from being moved into the sterile position and/or the locking element from being moved into the locking position when the sterile container is open.

SUMMARY

Against this background, it is an object of the present application to provide a device and an improved method by which microbial monitoring in an isolator can be enhanced. In particular, it is an object of the present application to improve the introduction of nutrient medium carriers into a barrier system, especially into an isolator, for microbial monitoring.

According to a first aspect, a transport container for at least one nutrient medium carrier is provided, wherein the transport container comprises a base element and a cover element, wherein the base element and the cover element are connectable to each other, wherein the base element and the cover element are connected to each other in a closed state of the transport container and enclose an interior space of the transport container, wherein the at least one nutrient medium carrier can be arranged in the interior space.

According to a second aspect, a method for automated microbial monitoring in a barrier system, particularly in an isolator, is provided. The method comprises the following steps:

- introducing at least one closed transport container into the barrier system, wherein each transport container contains at least one nutrient medium carrier;
- opening the transport container within the barrier system; and
- arranging the at least one nutrient medium carrier within the barrier system.

In particular, each transport container used in the method according to the second aspect is designed according to the first aspect. In a preferred embodiment of the method, the barrier system is an isolator. Specifically, in the step of opening, the transport container is opened within the closed isolator.

The term "nutrient medium carrier" is understood here to mean a device that is designed to carry a nutrient medium. A nutrient medium carrier can, for example, be a Petri dish or an agar plate in which the nutrient medium is arranged.

The transport container is a container used for the sterile transport of one or more nutrient medium carriers. Using the transport container, one or more nutrient medium carriers can be introduced into a barrier system, particularly into an isolator.

As mentioned at the outset, the term "isolator" is understood here to mean a space or chamber that is hermetically and gas-tight sealed from the surrounding workspace. The term isolator chamber can also be used for the isolator. Within the isolator, a defined atmosphere can be created for processing sensitive or hazardous products, particularly pharmaceutical or cosmetic products. The isolator can be an aseptic isolator. An aseptic isolator can, for example, be a clean room, ultraclean room, or the like.

The transport container comprises the base element and the cover element. The base element forms a main body of the transport container. The cover element forms a lid of the transport container. The base element and the cover element are connectable to each other. "Connectable" is understood to mean that the base element and the cover element can be operatively detachably connected to each other.

In a closed state of the transport container, the base element and the cover element are connected to each other. Specifically, the lid is placed on the main body. In an open state of the transport container, the base element and the cover element are not connected to each other but are separated. Specifically, the lid is removed from the main body. Placing the lid can also be referred to as closing the transport container, and removing the lid as opening the transport container.

The transport container has an interior space. In the closed state of the transport container, the base element and the cover element enclose the interior space. In other words, the interior space is formed by the base element and the cover element in the closed state. The environment of the interior space is isolated from the external environment in the closed state. Isolated means that there is no fluid or particle exchange between the two environments. The isolation can be achieved, for example, via a seal or sealing element.

For sterile transport, one or more nutrient medium carriers can be arranged in the interior space. For example, they can be placed on the base element when the cover element is removed. Specifically, multiple nutrient medium carriers can be stacked on the base element. The cover element can then be placed on top to close the transport container, so that the one or more nutrient medium carriers are then arranged in the interior space. In the closed state of the transport container, the one or more nutrient medium carriers are thus arranged in the interior space, particularly on the base element.

When one or more nutrient medium carriers are arranged in the closed transport container, the transport container can be introduced into the barrier system. The introduction can be done manually or with robotic assistance. The transport container can be introduced into the barrier system through any access point to the barrier system. If the barrier system is an isolator, access to the isolator can be, for example, in the form of an isolator door or a transfer lock (such as an alpha-beta port).

The term "robot-assisted" or "robot" is understood here to mean that the designated method steps are carried out by means of an automated movement apparatus of any kind. This can be, for example, a handling device, a manipulator, kinematics, or the like, that forms the robot. A "robot" refers to a movement apparatus that has at least one, particularly articulated, support structure at the end of which a robot end effector is arranged. The support structure is designed to move the robot end effector in all three spatial directions.

For microbial monitoring, one or more transport containers can be introduced into the barrier system. If the barrier system is an isolator, the one or more transport containers can be introduced into the isolator with the isolator door open. In particular, the barrier system can be decontaminated after each transport container is introduced and before they are opened. During decontamination, the transport container is in a closed state. In particular, the outer surface of the transport container is also decontaminated when decontaminating the barrier system. If the barrier system is an isolator, decontamination is performed in the closed isolator.

In the barrier system, each transport container is then opened, and each nutrient medium carrier contained therein is arranged at a specific position within the barrier system. The specific position can also be referred to as a storage location for the respective nutrient medium carrier. Each transport container can be opened, in particular, by removing the cover element from the base element. To arrange a nutrient medium carrier within the barrier system, it can be removed from the transport container and transferred or brought to the corresponding storage location. Each nutrient medium carrier remains at its storage location for a specific period, corresponding to the duration of the microbial monitoring. While the nutrient medium carrier is at the storage location, it can collect microbes from the environment of the storage location. The storage location can alternatively serve as an interim storage or intermediate station for one or more nutrient medium carriers. From the interim storage or intermediate station, each of these nutrient medium carriers can then be transferred or brought to another storage location for microbial monitoring at a specific time. The interim storage or intermediate station can be isolated from the environment of the barrier system.

The opening of the transport container and the arrangement of the one or more nutrient medium carriers within the barrier system are preferably carried out robot-assisted, particularly by means of one or more handling devices. For example, a handling device can grasp and remove the lid to open the transport container. Then, the same handling device or another handling device can sequentially grasp each nutrient medium carrier arranged on the base element and transport it to the specific position within the barrier system and set it down there.

The base element and the cover element of the transport container can each be made of plastic or a metal (e.g., stainless steel or aluminum).

The transport container has only a few and, above all, space-saving components (particularly a base element and a cover element). The setup, i.e., the insertion of the nutrient medium carriers into the transport container and the closing of the transport container, can be carried out in a preparation isolator. For setup in a preparation isolator, transport containers designed for multiple uses are preferably used. For multiple uses, the cover element and the base element are preferably made of a metal, particularly stainless steel.

Alternatively, the transport container can also be provided directly as a unit, preloaded with the nutrient medium carriers, from the manufacturer, preferably as a disposable product (gamma-sterilized and packaged). For a disposable product, the cover element and the base element are preferably made of plastic.

The preloaded transport container (or also several preloaded transport containers) can now be freely placed in the system, particularly in the barrier system. The storage location and the position of the handling manipulator can thus be optimally chosen without having to consider the proximity to a wall, particularly an isolator wall. Furthermore, the introduction of the transport container can be done with the isolator doors open if the barrier system is an isolator. The outer surfaces of the transport container are later decontaminated with the entire system.

After completing the batch, the nutrient media can be placed back into the transport container. The container is then closed again so that the system can be decontaminated or cleaned with water, cleaning agents, or the like before opening the isolator. The decontaminated or cleaned transport container can then be removed from the system without restrictions for evaluating the nutrient media, with the nutrient media being protected by the transport container during transport.

The device and method according to the application may have the following advantages. First, the components are inexpensive. Furthermore, there is independence from other component manufacturers. Additionally, the placement in the system, i.e., in the barrier system, is flexible. Moreover, in certain cases/embodiments, there is no need for further transferring of the individual nutrient medium carriers to a nutrient medium carrier holder. In other words, the new transport container and method improve and make the introduction of nutrient medium carriers into a barrier system for microbial monitoring more process-safe, reducing the risk of operator errors.

The initially stated objective is thus fully achieved.

In a first embodiment, the base element is plate-shaped and the cover element is hood-shaped.

As explained at the outset, the one or more nutrient medium carriers can be arranged on the base element for transport. If the base element is plate-shaped and the cover element is hood-shaped, the insertion and removal of the nutrient medium carriers into and from the transport container are facilitated. In particular, the one or more nutrient medium carriers can be more easily arranged on and removed from the base element because the location where the nutrient medium carriers are arranged on the base element is more accessible due to the plate-shaped design of the base element. This is particularly advantageous when the nutrient medium carriers are handled robotically, especially within the barrier system.

In a further embodiment, the cover element comprises a ring and a hood, wherein the hood is arranged on the side of the ring opposite the base element and is connected to the ring.

The ring is preferably dimensionally stable. The ring can be designed to connect the cover element to the base element. The ring serves to connect the cover to the main body. The hood serves to enclose the interior space on the side of the ring opposite the base element.

In a further embodiment, the base element and the cover element are mechanically or magnetically coupleable to each other to hold the transport container in the closed state.

In this way, the transport container is sealed. This prevents the transport container from accidentally opening during sterile transport.

In a further embodiment, the base element comprises a first coupling element and the cover element comprises a second coupling element, wherein the first coupling element and the second coupling element are coupleable to each other to couple the base element and the cover element.

The coupling using the two coupling elements can be mechanical or magnetic, for example. In a magnetic coupling, the coupling elements can be magnets, for example. In a mechanical coupling, the coupling elements can be designed to complement each other, so that they can interlock or snap into place to couple. In particular, one coupling element can be a receptacle and the other coupling element can be a clip, a hook, or a protrusion that can snap into the receptacle.

In a further embodiment, the base element and the cover element are mechanically coupleable via a bayonet lock.

For example, the base element can have a tab and the cover element can have a corresponding slot. The tab can engage with the slot to hold the transport container in the closed state. Preferably, the base element has a plurality of tabs (for example, two or three) and the cover element has a corresponding plurality of slots (also, for example, two or three). In this way, the base element and the cover element can be easily and securely coupled to each other.

In a further embodiment, the base element and the cover element each have one or more magnets by which the base element and the cover element are magnetically coupleable.

The magnets are preferably permanent magnets. The magnets can be arranged so that in the closed state, each magnet of the base element magnetically couples with a corresponding magnet of the cover element. In this way, the base element and the cover element can be easily and securely coupled to each other.

In a further embodiment, the base element and the cover element are designed so that the mechanical or magnetic coupling can be released using a, particularly specific, tool or by inserting into a, particularly specific, receptacle or station.

This ensures that the transport container, e.g., a bayonet lock, does not accidentally open during transport. In particular, the base element and the cover element can only be separated using a specific tool or by inserting into a specific receptacle or station. The transport container interacts with the tool or the receptacle or station in such a way that the mechanical or magnetic coupling is released. This allows the transport container to be opened, i.e., transitioned from the closed to the open state. The tool or the receptacle or station can interact in such a way that a locking mechanism of the transport container, for example, a pin, is released, allowing the cover to be lifted off. The tool can be handled robotically within the barrier system (using a handling device) to manipulate the transport container. The tool can, for example, be formed or arranged on an end effector of a handling device or handling robot. The receptacle or station can, for example, be provided in the barrier system, particularly at the storage location, or in a laboratory, particularly at the evaluation location.

In a further embodiment, the transport container comprises a seal arranged between the base element and the cover element.

The seal serves to seal the transport container in the closed state. The seal can be, for example, a sealing lip, an O-ring, or a sealing cord. In particular, the base element can have a groove for the seal. For example, the groove can run along the edge of the base element, with the seal placed in the groove.

In a further embodiment, the base element comprises a receptacle for the one or more nutrient medium carriers.

The receptacle serves to hold the one or more nutrient medium carriers. The receptacle can be designed to surround, in particular hold, the nutrient medium carriers laterally when the one or more nutrient medium carriers are arranged therein. The receptacle allows the nutrient medium carriers to be securely held within the interior space during transport.

In a further embodiment, the receptacle comprises one or more receiving elements, wherein the receiving elements are arranged to surround, in particular hold, one or more nutrient medium carriers when they are arranged in the receptacle.

The receiving elements can be arranged to surround, in particular hold, the nutrient medium carriers to be held. The receiving elements extend, preferably vertically, from the base element into the interior space. The receiving elements are preferably arranged at the edge of the base element. The receiving elements can, in particular, be evenly distributed along the edge of the base element. In this way, the nutrient medium carriers can be securely held within the interior space during transport.

In a further embodiment, the method comprises the following steps prior to the step of introducing:

loading the at least one transport container with one or more nutrient medium carriers; and closing each loaded transport container.

The loading and closing of the transport container are preferably carried out in a preparation isolator. In this way, the nutrient medium carriers are enclosed in the respective transport container in a sterile manner and can thus be introduced into the barrier system for microbial monitoring in a sterile condition.

In a further embodiment, in the step of arranging, each nutrient medium carrier is arranged at a specific position within the barrier system, wherein each nutrient medium carrier remains at the defined position for a specific period.

By arranging and keeping each nutrient medium carrier at a specific position within the barrier system for the specific period, microbial monitoring is carried out over the specific period.

In a further embodiment, the method comprises the following steps after the step of arranging:

placing each nutrient medium carrier back into the respective transport container; and closing the respective transport container.

After microbial monitoring, particularly at the specific position within the barrier system, each nutrient medium carrier is placed back into the respective transport container. The transport container is then closed again. The nutrient medium carriers are thus isolated from the environment again and do not collect any more microbes from the environment of the barrier system.

In a further embodiment, the method comprises the following step:

removing each reclosed transport container from the barrier system.

In the reclosed state, each transport container can then be removed from the barrier system and transported, for example, to a laboratory for evaluation and analysis. In particular, the barrier system can be decontaminated after each transport container is reclosed and before they are removed. During decontamination, the transport container is in the closed state. In particular, the outer surface of the transport container is also decontaminated when decontaminating the barrier system.

It is understood that the features mentioned above and those to be explained below can be used not only in the specified combination but also in other combinations or individually, without departing from the scope of the present invention.

DRAWINGS

Figure 2:
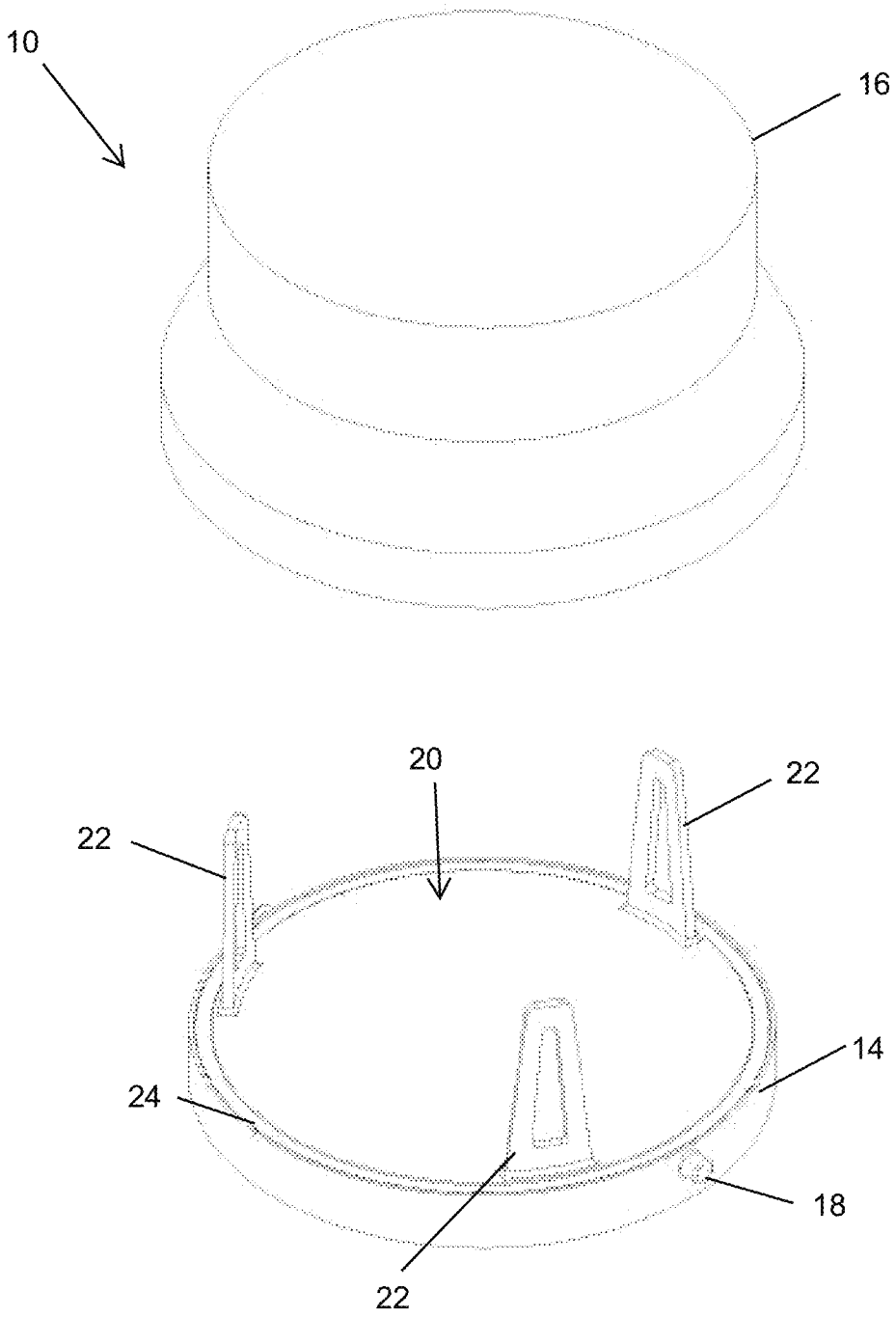
Figure 3:
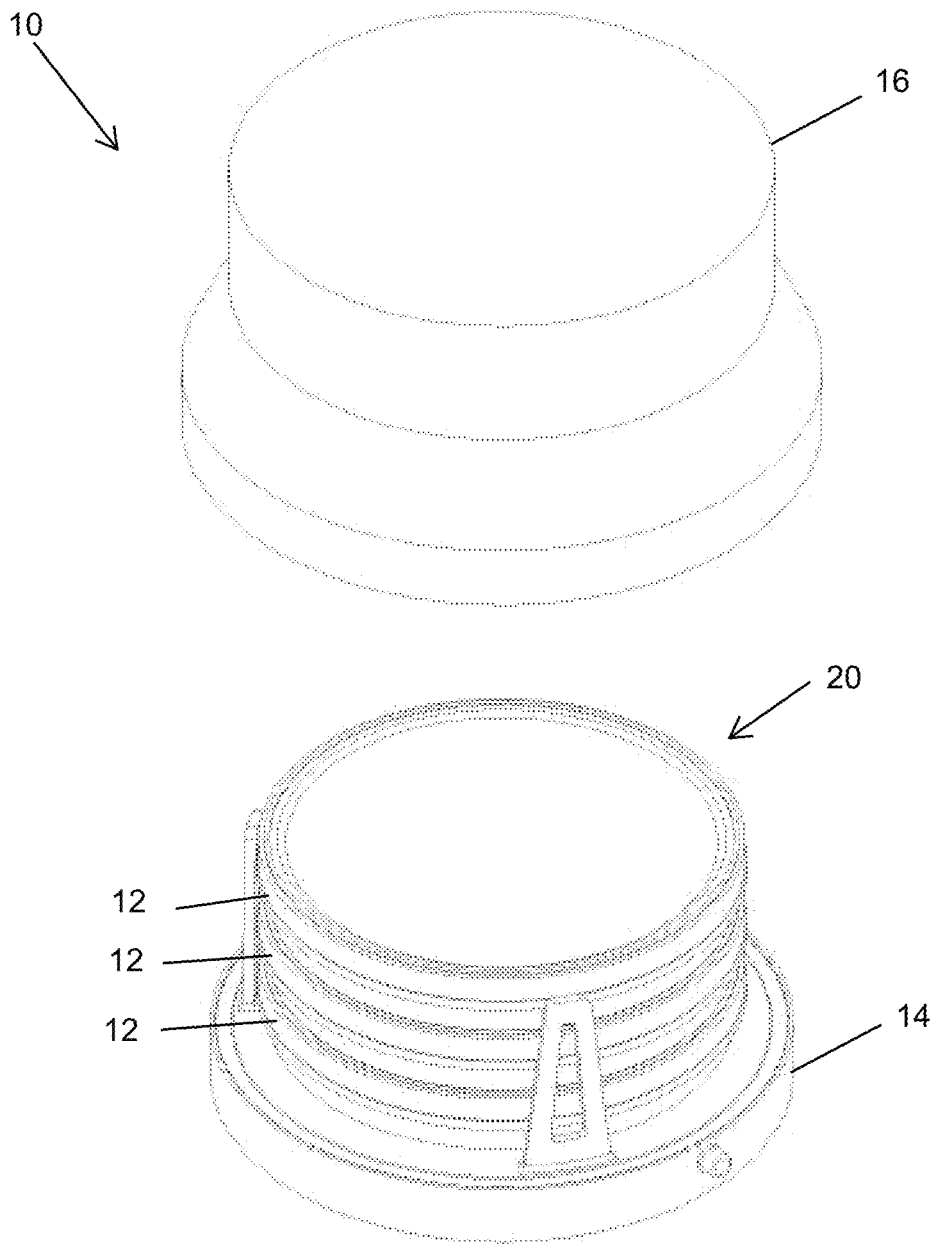
Figure 4:
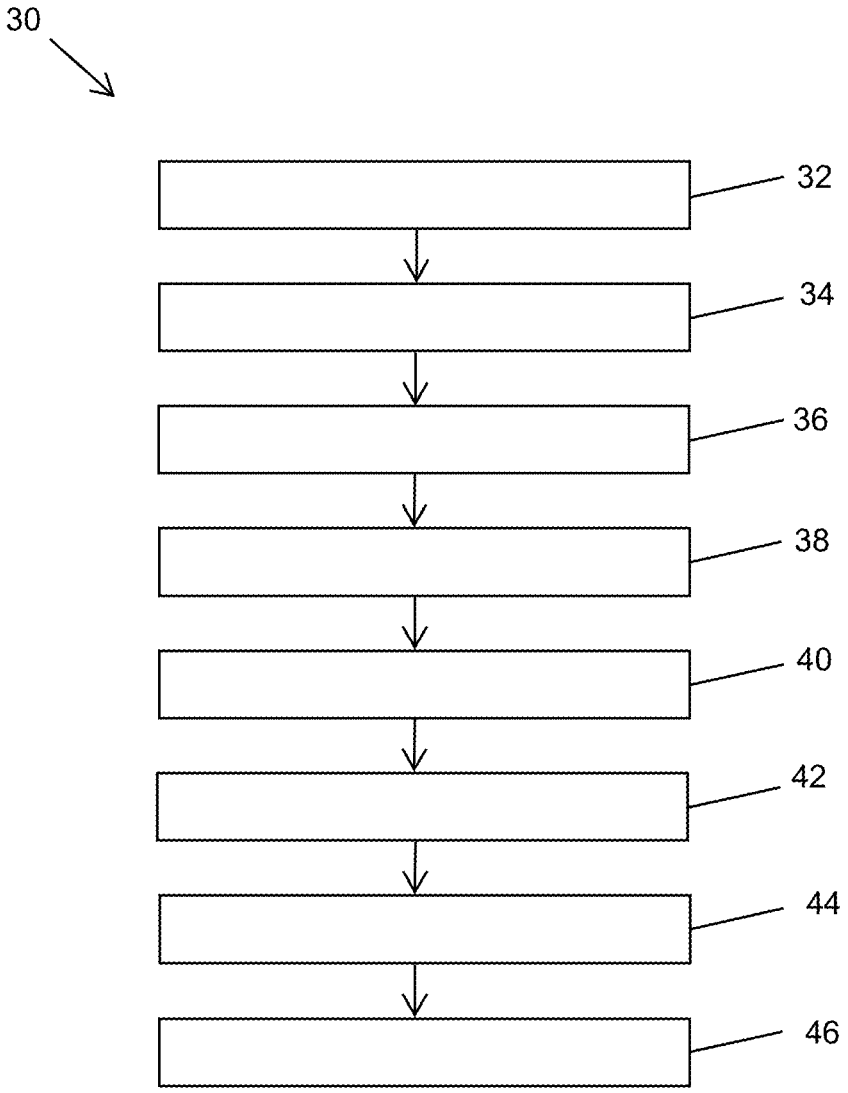

Embodiments of the invention are illustrated in the drawings and are explained in more detail in the following description. The figures show:

FIG. 1 a depiction of an embodiment of a transport container in the closed state;

FIG. 2 a depiction of the transport container from FIG. 1 in the open state;

FIG. 3 a depiction of the transport container from FIG. 1 in the open state with nutrient medium carriers arranged therein; and FIG. 4 a schematic depiction of an embodiment of a method.

DETAILED DESCRIPTION OF THE INVENTION

FIGS. 1 and 2 show a transport container 10. The transport container 10 is used for the sterile transport of one or more nutrient medium carriers 12. The transport container 10 comprises a base element 14 and a cover element 16. The base element 14 forms a main body of the transport container 10. Preferably, the base element 14 is designed as a, preferably round, plate. The cover element 16 forms a lid of the transport container 10. Preferably, the cover element 16 is designed as a hood. The base element 14 and the cover element 16 can each be made of a plastic or a metal (for example, aluminum or stainless steel).

The base element 14 and the cover element 16 are connectable to each other. In a closed state of the transport container 10, the base element 14 and the cover element 16 are connected to each other. Specifically, the lid is placed on the main body. In an open state of the transport container 10, the base element 14 and the cover element 16 are not connected to each other but are separated. Specifically, the lid is removed from the main body. Placing the lid can also be referred to as closing the transport container 10, and removing the lid can be referred to as opening the transport container 10.

The base element 14 and the cover element 16 are coupleable to each other to hold the transport container 10 in the closed state. The coupling can be mechanical or magnetic, for example. Different closure systems can be used for this purpose.

For example, the closure system can have a tab and a slot that can couple with each other. Such a closure system is also referred to as a bayonet lock. A bayonet lock is an example of a mechanical coupling. Specifically, the base element 14 can have a tab 18 and the cover element 16 a corresponding slot (not shown), wherein the tab can engage with the slot to hold the transport container 10 in the closed state. Preferably, the base element 14 has at least three tabs, and the cover element 16 has at least three corresponding slots.

Alternatively, a magnetic closure system can be used. For example, one or more magnets (permanent magnets) can be arranged on the base element 14 and the cover element 16. Each magnet of the cover element 16 can then magnetically couple with a corresponding magnet of the base element 14 to hold the transport container 10 in the closed state.

Alternatively, a closure system can be used that can only be opened when the transport container 10 is placed on a specific receptacle or station (particularly at the storage location or evaluation location), wherein the locking mechanism, for example, a pin, is released, and only then can the lid be lifted. Alternatively, a closure system can be used that can only be opened using a specific tool. Here, too, the locking mechanism, for example, a pin, can be released using the tool, and only then can the lid be lifted. This would have the advantage that the transport container 10, e.g., a bayonet lock, does not accidentally open during transport. In other words, the opening of the transport container 10 could be done via an actively operating unlocking station, for example, by an actively actuated mechanism.

The transport container 10 has an interior space. In the closed state of the transport container 10, the base element 14 and the cover element 16 enclose the interior space. The environment of the interior space is isolated from the external environment in the closed state. Isolated means that there is no fluid or particle exchange between the two environments. In particular, the transport container 10 can have a seal, particularly a sealing lip, an O-ring, or a sealing cord, for sealing, arranged between the base element 14 and the cover element 16, particularly along their connection point. The base element can have a groove 24 for the seal, which runs along the edge. The seal can be placed in the groove 24 for sealing.

The one or more nutrient medium carriers 12 can be arranged in the interior space, particularly for transport. The base element 14 can, for example, have a receptacle 20 for the one or more nutrient medium carriers 12. The receptacle 20 is arranged in the interior space in the closed state. When nutrient medium carriers 12 are arranged in the receptacle 20, these nutrient medium carriers are also arranged in the interior space when the transport container 10 is in the closed state. The receptacle 20 can be formed by one or more receiving elements 22. The receiving elements 22 can be arranged to surround, in particular hold, the nutrient medium carriers 12 to be held. Multiple nutrient medium carriers 12 can be arranged in the receptacle 20. The nutrient medium carriers 12 can, in particular, be stacked in the receptacle 20. The receiving elements 22 extend, preferably vertically, from the base element 14 into the interior space. In particular, the receptacle 20 is formed by at least three receiving elements 22. The receiving elements 22 are preferably arranged at the edge of the base element 14. The receiving elements 22 are preferably evenly distributed along the edge of the base element. The receiving elements 22 are particularly arranged at or near the groove 24, especially internally.

The cover element 16 is preferably rigid or stiff. In particular, the cover element 16 can be made of a metal, aluminum, stainless steel, or a plastic. The cover element 16 can, for example, have a minimum wall thickness of 2 mm, 3 mm, 4 mm, or 5 mm.

The cover element 16 can also be designed in two parts. For example, the cover element 16 can comprise a ring and a hood. The ring is designed to couple with the base element 14 to connect the cover element 16 to the base element 14. In other words, the ring is arranged in the area of the seal or closure. The hood is arranged on the side of the ring opposite the base element 14 and is connected to the ring. In particular, the hood closes off this side of the ring. The ring is preferably dimensionally stable (for example, made of a metal or plastic). The hood preferably consists of a (dimensionally stable) film, particularly a plastic film.

In FIG. 3, three nutrient medium carriers 12 are shown stacked on top of each other in the receptacle 20 of the transport container 10.

FIG. 4 shows a method 30 for automated microbial monitoring in a barrier system. In the steps of method 30, an isolator is used as the barrier system. However, method 30 can also be carried out with any other barrier system.

In a first step 32 of method 30, one or more transport containers 10 are loaded with one or more nutrient medium carriers 12. For this purpose, the nutrient medium carriers 12 are arranged in the receptacles 20 of the respective transport container 10, in particular inserted into them. Each transport container 10 thus contains at least one nutrient medium carrier 12.

In a further step 34 of method 30, each transport container 10 is closed. For this purpose, the cover element 16 is connected to the base element 14, in particular coupled.

Steps 32 and 34 can be carried out in a preparation isolator.

In a further step 36 of method 30, each transport container 10 is introduced into the isolator, in particular transported or transferred into the isolator. Each transport container 10 is arranged at a specific position within the isolator.

Step 36 can be carried out, in particular, before the isolator is decontaminated. In this case, the outer surface of the transport container 10 can be decontaminated together with the entire isolator after introduction. The introduction can take place in particular through the opened isolator door.

In a further step 38 of method 30, each transport container 10 is opened. For this purpose, the cover element 16 is separated from the base element 14, in particular decoupled, so that the cover element 16 can be removed from the transport container 10, in particular from the base element 14. Step 38 preferably takes place within the closed isolator, i.e., when all accesses are closed.

In a further step 40 of method 30, each nutrient medium carrier 12 is arranged at a specific position (a storage location) within the isolator. For this purpose, the nutrient medium carrier 12 is removed from the transport container 10, in particular from the receptacle 20, transferred to the storage location, and placed there.

Each nutrient medium carrier 12 remains at the respective storage location for a specific period, which corresponds to the duration of the microbial monitoring. While the nutrient medium carrier 12 is at the storage location, it can collect microbes from the environment of the storage location.

Alternatively, the storage location can also serve as an interim storage or intermediate station for one or more nutrient medium carriers. From the interim storage or intermediate station, each of these nutrient medium carriers can then be transferred or brought to another storage location for microbial monitoring for the specific period at a specific time. The interim storage or intermediate station can be isolated from the environment of the isolator.

In a further step 42 of method 30, each nutrient medium carrier 12 is placed back into the respective transport container 10, in particular reset into it.

In a further step 44 of method 30, each transport container 10 is then closed again. For this purpose, the cover element 16 is placed back on and connected to the base element 14, in particular coupled.

In a further step 46 of method 30, each transport container 10 is then removed from the isolator for further evaluation/analysis of the nutrient media of the nutrient medium carriers 12. The removal can take place, in particular, after a renewed decontamination or cleaning of the isolator.

All steps of the method can be carried out, in particular, robot-assisted (i.e., by means of one or more handling robots).

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A method for automated microbial monitoring in a barrier system, the method comprising the steps of:

introducing at least one closed transport container into the barrier system, wherein each closed transport container contains at least one nutrient medium carrier;

opening the at least one closed transport container within the barrier system;

arranging the at least one nutrient medium carrier within the barrier system;

placing the at least one nutrient medium carrier back into the at least one opened transport container; and closing the at least one opened transport container.

2. The method according to claim 1, wherein each closed transport container comprises a base element and a cover element, wherein the base element and the cover element are connectable to each other, wherein the base element and the cover element are connected to each other in a closed state of the respective transport container and enclose an interior space of the respective transport container, wherein the at least one nutrient medium carrier is arranged in the interior space of the respective transport container.

3. The method according to claim 1, wherein the method comprises the following steps before the introducing step:

loading at least one transport container with the at least one nutrient medium carrier; and closing each loaded transport container.

4. The method according to claim 1, wherein in the arranging step, each nutrient medium carrier is arranged at a specific position within the barrier system, and each nutrient medium carrier remains at the specific position for a certain period of time.

5. The method according to claim 1, wherein the method comprises the following step:

removing each closed transport container from the barrier system.

* * * * *